US006098329A

United States Patent [19]

Rowen et al.

[11] Patent Number: 6,098,329

[45] Date of Patent: Aug. 8, 2000

[54] TAG PROTECTOR

[75] Inventors: Christopher G. Rowen, Rockport; Kevan Hobbs, Gloucester, both of Mass.

[73] Assignee: Cyrk, Inc., Gloucester, Mass.

[21] Appl. No.: 09/136,788

[22] Filed: Aug. 19, 1998

[51] Int. Cl.[7] ..... G09F 3/18

[52] U.S. Cl. ..... 40/661; 40/661.06; 206/449

[58] Field of Search ..... 40/634, 661, 661.05, 40/661.06, 705, 779; 206/0.8, 0.82, 232, 449, 450; 63/19; 70/456 R, 460; 292/307 A, 307 B; 150/147

[56] References Cited

U.S. PATENT DOCUMENTS

| | | | |
|---|---|---|---|
| 2,856,761 | 10/1958 | Donle | 63/19 |
| 2,863,307 | 12/1958 | Donle | 63/19 |
| 3,808,722 | 5/1974 | Byers et al. | 40/705 |
| 4,043,858 | 8/1977 | Dantowitz . | |
| 4,215,497 | 8/1980 | Levy | 40/649 |
| 4,322,001 | 3/1982 | Hurley | 206/449 |
| 4,326,349 | 4/1982 | Daughtry | 40/733 |
| 4,524,867 | 6/1985 | Klein et al. | 40/661 X |
| 4,829,691 | 5/1989 | Manjos et al. | 40/661 |
| 4,984,683 | 1/1991 | Eller | 40/661.06 X |
| 5,010,673 | 4/1991 | Connor et al. | 40/661 |
| 5,056,660 | 10/1991 | Huang | 40/902 X |
| 5,148,618 | 9/1992 | Brewster | 40/626 |
| 5,414,948 | 5/1995 | Kudo | 40/651 |
| 5,522,163 | 6/1996 | Neugebauer | 40/780 |
| 5,845,424 | 12/1998 | Mitchell | 40/661 X |

OTHER PUBLICATIONS

"A Dream Come True", Mary Beth's Beanie World Monthly, Collector's Edition No. 6, vol. 1, No. 6, Aug. 1998.

"Protect–A–Tag 2000", Mary Beth's Beanie World Monthly, Collector's Edition No. 6, vol. 1, No. 6, Aug. 1988.

"Heart–Tite is the clear choice", Mary Beth's Beanie World Monthly, Collector's Edition No. 6, vol. 1, No. 6, Aug. 1998.

"Don't Break My Heart", Mary Beth's Beanie World Monthly, Collector's Edition No. 6, vol. 1, No. 6, Aug., 1998.

*Primary Examiner*—Brian K. Green

*Attorney, Agent, or Firm*—Christie, Parker & Hale, LLP

[57] ABSTRACT

A removable tag protector is provided for releasably enclosing a generally planar tag having a predetermine shape with a fold line that separates the tag into front and back sides. The tag protector comprises a base shaped generally as the unfolded tag. The base has an inside face with a front half and a back half so that the tag, when in its unfolded position, can overlie the front and back halves of the base, respectively. The protector further comprises a fold section dividing the front and back halves of the base so that the front and back halves of the base can be folded into an overlapping position when the base is folded along the fold section. A front wall section is located along an outside edge of the front half of the base, and a rear wall section is located along an outside edge of the back half of the base. The protector further comprises an inside front protective section for overlying the front side of the unfolded tag when positioned to overlie the base, and an inside rear protective section for overlying the back side of the unfolded tag when positioned to overlie the base. A cooperating closing mechanism is provided on the front and rear wall sections arranged so that the tag protected can be closed in a releasably fastened position when the front and back halves of the base are folded along the fold section and moved to an overlapping position. In operation, a tag positioned on the base is moved to a folded position in response to the front and back halves being folded to the fastened position, capturing the folded tag inside the folded base with the front and rear protective sections overlying their respective sides of the tag and contained within the fastened and folded base.

25 Claims, 2 Drawing Sheets

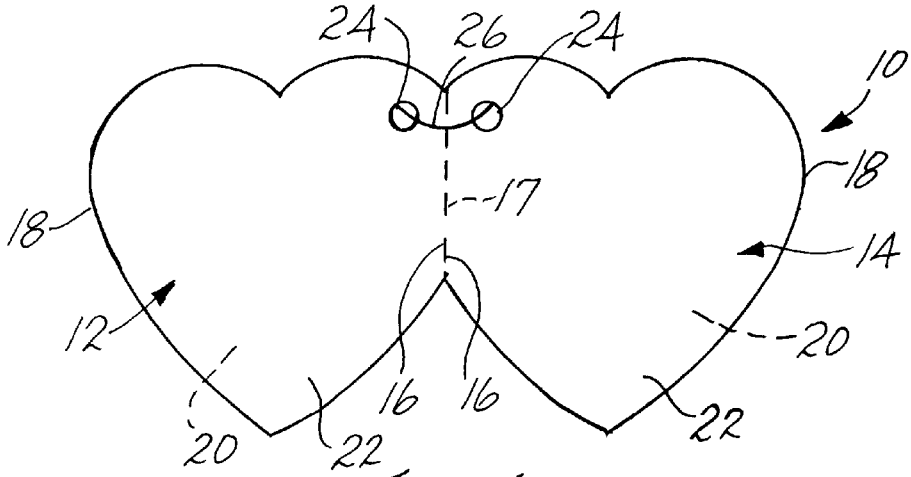
Fig. 1
Fig. 2
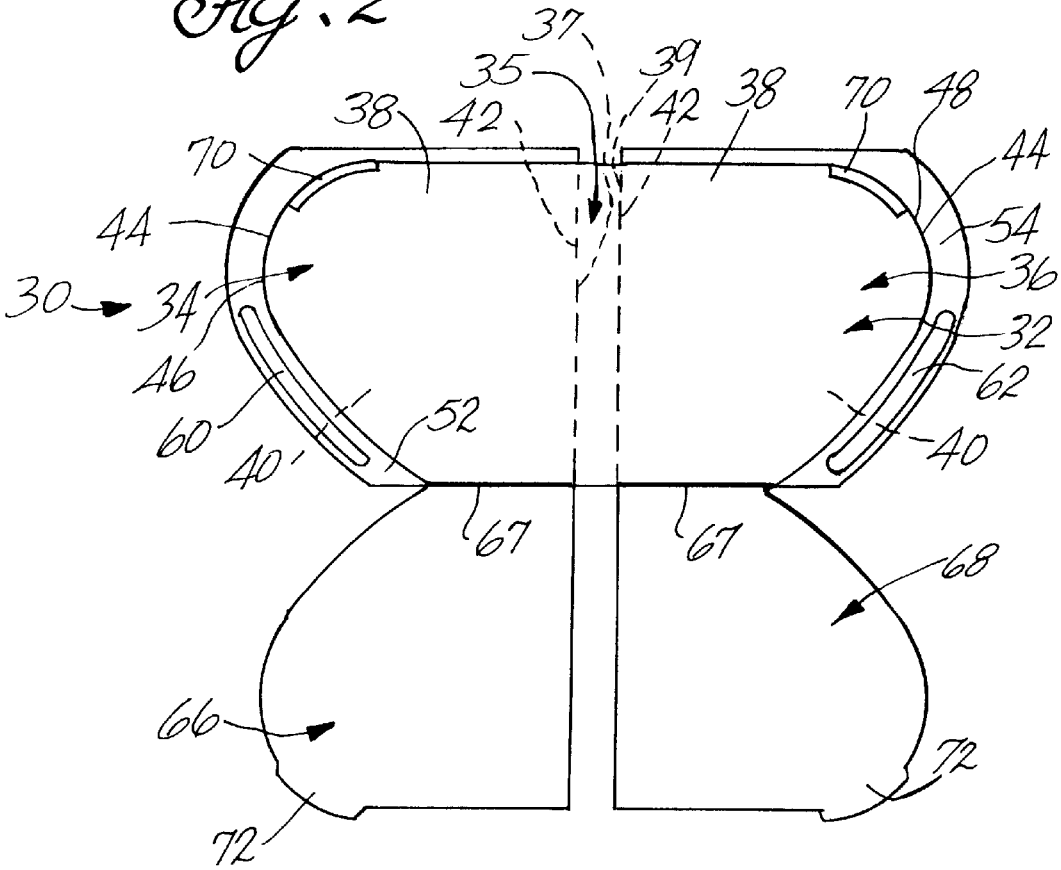

TAG PROTECTOR

FIELD OF THE INVENTION

The present invention is directed to tag protectors, and more particularly to tag protectors for multi-faced folding tags.

SUMMARY OF THE INVENTION

The present invention is directed to a removable tag protector for releasably enclosing a generally planar tag having a predetermine shape with a fold line that separates the tag into front and back sides. In one embodiment, the tag protector comprises an outside section having a midsection and front and back halves. The front and back halves each have an inside face, an outside face, an inner edge, and an outer edge. The front and back halves each also have a front wall and back wall, respectively, extending along at least a part of its outer edge. The midsection has front and back side edges. The inner edge of the front half is joined to and foldable along the front edge of the midsection, and the inner edge of the back half is joined to and foldable along the back edge of the midsection. The outside section is capable of being folded to form an inner region between the front half and back half.

The protector further comprises an inside front section and an inside back section, each having an inside face and an outside face. The inside front section is capable of being positioned within the inner region of the outside section so that the inside front section is generally parallel to the inside face of the front half. The inside back section is capable of positioned within the inner region of the outside section so that the inside back section is generally parallel to the inside face of the back half.

A closing means is provided that is capable of attaching the outer edge of the front half of the outside section to the outer edge of the back half of the outside section. A preferred closing means is a snapping mechanism.

In another embodiment, the tag protector comprises a base shaped generally as the unfolded tag. The base has an inside face with a front half and a back half so that the tag, when in its unfolded position, can overlie the front and back halves of the base, respectively. The protector further comprises a fold section dividing the front and back halves of the base so that the front and back halves of the base can be folded into an overlapping position when the base is folded along the fold section. A front wall section is located along an outside edge of the front half of the base, and a rear wall section is located along an outside edge of the back half of the base. The protector further comprises an inside front protective section for overlying the front side of the unfolded tag when positioned to overlie the base, and an inside rear protective section for overlying the back side of the unfolded tag when positioned to overlie the base. A cooperating closing mechanism is provided on the front and rear wall sections arranged so that closing means are formed together in a releasably fastened position when the front and back halves of the base are folded along the fold section and moved to an overlapping position. In operation, a tag positioned on the base is moved to a folded position in response to the front and back halves being folded to the fastened position, capturing the folded tag inside the folded base with the front and rear protective sections overlying their respective sides of the tag and contained within the fastened and folded base.

DESCRIPTION OF THE DRAWINGS

These and other features and advantages of the present invention will be better understood by reference to the following detailed description when considered in conjunction with the accompanying drawings, where same reference numerals identify similar elements, wherein:

FIG. 1 is a front elevational view of a multi-faced folding tag in an open position.

FIG. 2 is a front elevational view of a tag protector according to the invention shown in an open position.

DETAILED DESCRIPTION

Figure 3:
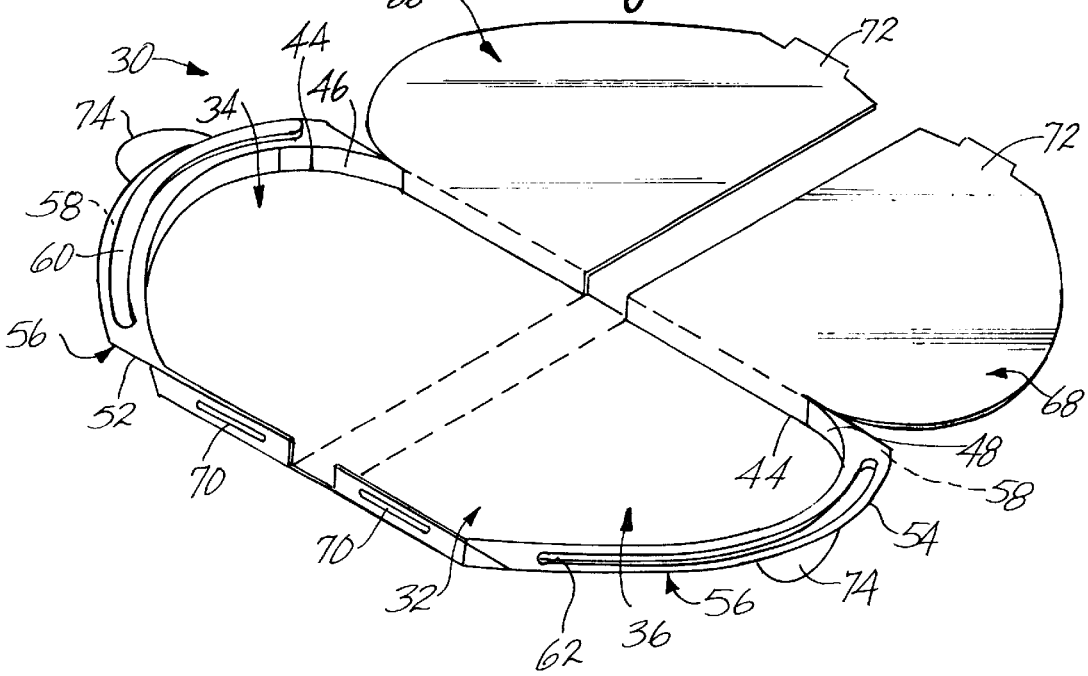
FIG. 3 is a fragmentary perspective view of an alternative embodiment of an open tag protector according to the invention.

The present invention is directed to tag holders that protect a multi-faced folding tag. An exemplary multi-faced folding tag 10 is depicted in FIG. 1. The folding tag 10 has a front panel 12 and a back panel 14, each of which has an inside edge 16 and an outside edge 18. Each panel 12 and 14 also has an outer face 20 and an inner face 22. The front panel 12 and back panel 14 are joined at their inside edges 16, along a straight fold line 17, allowing their inner faces 22 to contact when the tag 10 is folded. The front panel 12 and back panel 14 have generally the same shape, so that when the tag 10 is folded, their outside edges 18 are generally aligned. In the depicted embodiment, the tag 10, when closed, is generally heart-shaped, although other shapes are possible. Additionally, each panel 12 and 14 further comprises an opening 24 through which a string 26 or the like extends to attach the folding tag 10 to a stuffed animal (not shown) or other object. The inventive tag protectors allow the user to open the folding tag 10 to view the inner faces 22 of the panels 12 and 14, while protecting both the outer faces 20 and inner faces 22 of the panels.

FIG. 2 illustrates one embodiment of a tag protector 30 in accordance with the present invention. The tag protector 30 comprises a unitary structure having an outside section 32 with a front half 34, a midsection 35, and a back half 36. The front half 34 and the back half 36 each have an inside face 38, an outside face 40, an inner edge 42, and an outer edge 44. (The inner edges 42 are defined as straight fold lines when the protector is moved toward its folded position.) The midsection 35 therefore has two spaced apart, parallel front and back side edges 37 and 39, which are defined when the protector is folded, as described below. The inner edge 42 of the front half 34 is integrally joined to and foldable along the front edge 37 of the midsection 35, and the inner edge 42 of the back half 36 is integrally joined to and foldable along the back edge 39 of the midsection 35.

As shown in FIGS. 2 and 3, near the outer edge 44 of the front half 34 is a front wall 46 that extends along the outer side, bottom and top edges of the front half. A corresponding back wall 48 extends along the outer side, bottom and top edges of the back half 36. The front and back walls 46 and 48 provide an interior region 50, shown best in FIG. 4, in which the tag 10 can be contained.

Similar to the tags 10 described above, the front half 34 and back half 36 of the protector 30 25 have generally the same shape so that when the protector 30 is folded, the outer edges 44 of the front and back halves are generally aligned. Preferably the front half 34 and back half 36 of the protector 30 each have a shape similar to those of the front and back panels 12 and 14, respectively, of the tag 10 for which the protector 30 will be used. The protector 30, when closed, preferably has a size slightly larger that of the closed tag 10 for which the protector will be used. In the depicted embodiment, the protector 30, when closed, is generally heart-shaped, having flat top and bottom edges and is capable of holding a heart-shaped tag 10, as described above.

Figure 4:
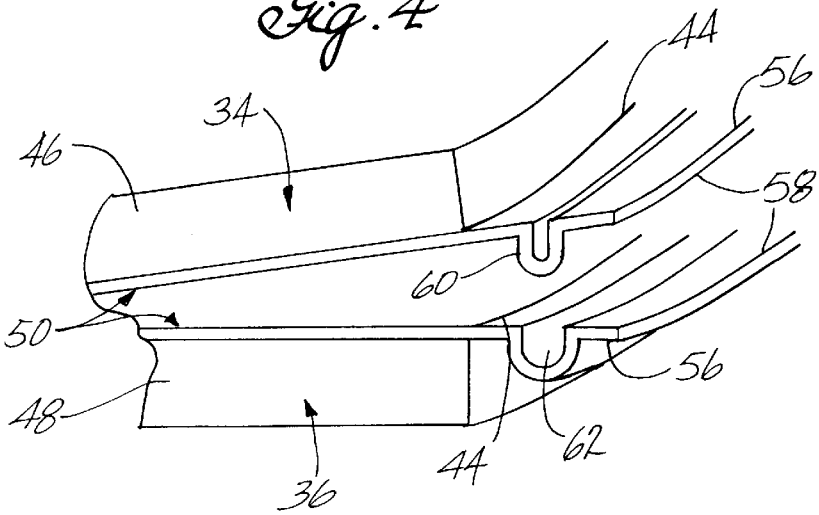
FIG. 4 is a perspective view of a closing means on a tag protector according to the invention.

So that the protector 30 can be held in place when closed, a snapping mechanism is provided. As shown in FIGS. 2, 3 and 4, the snapping mechanism comprises a front border 52 shaped as a curved outwardly projecting flange, which extends along the top and side of the outer edge 44 of the front half 34, and a back border 54 also shaped as a curved outwardly projecting flange, which extends along the top and side of the outer edge 44 of the back half 36. Each border 52 and 54 has an outer surface 56 and an inner surface 58. A curved ridge 60 projects along a part of the inner surface 58 of the front border 52. A corresponding groove 62 extends along a part of the inner surface 58 of the back border 54. The groove 62 is capable of snapably receiving the ridge 60 to releasably hold the opposite sides of the protector together when they are in folded position. As would be recognized by one skilled in the art, numerous variations of the depicted snapping mechanism could be used in the inventive tag protector, for example, by changing the shape and/or the number of snapping mechanisms or by locating the ridge 60 on the back border 54 and the groove 62 on the front border 52. Alternatively, a different closing means could be provided, so long as it is capable of allowing the user to repeatedly open and close the tag protector in a relatively simple manner.

To protect the inner faces 22 of the tag 10, the unitary structure of the tag protector 30 further comprises an inside front section 66 and an inside back section 68. The inside front and back sections 66 and 68 each have a size and shape generally the same as the interior region 50 of the front half 34 and back half 36 of the outside section 32, respectively. In the embodiment depicted in FIG. 2, the inside front section 66 is foldably attached along its bottom edge to the bottom of the front wall 46 on the front half 34 of the outside section 32. Similarly, the inside back section 68 is foldably attached along its bottom edge to the bottom of the back wall 48 on the back half 36 of the outside section. In operation, the inside front and back sections 66 and 68 are folded along straight fold lines 67 to generally enclose the interior region 50 of the outside section 32 so that the inside front section is generally parallel to the inside face of the front half and the inside back section is generally parallel to the inside face of the back half.

As would be recognized by one skilled in the art, the inside front and back sections 66 and 68 can each be attached to any edge of the walls 46 and 48 of the front and back halves 24 and 36, respectively. For example, FIG. 3 depicts an embodiment of the inventive tag protector 30 where the inside front and back sections 66 and 68 are attached to the top edges of the front wall 46 and back wall 48, respectively. Alternatively, the inside front and back sections 66 and 68 need not be integral with the outside section 32.

The inside front and back sections 66 and 68 are held in place in the inner region 50 of the outside section 32 by a locking means. In the embodiment depicted in FIG. 3, the locking means comprises slits 70 in the front and back walls 46 and 48, along their bottom edges. The locking means further comprises corresponding tabs 72 along the bottom edge of the inside front and back sections 66 and 68. The slits 70 and tabs 72 are sized and positioned to permit the slits 70 to receive the tabs 72 when the inside front and back sections 66 and 68 are folded to enclose the interior region 50 of the outside section 32. The tabs 72 are made from a resilient plastic material that enables them to flex sufficiently to be fitted into the slits 70. As would be recognized by one skilled in the art, the slits 70 and tabs 72 can be in any suitable position on the protector 30. For example, in the embodiment depicted in FIG. 2, the slots 70 are located in the top outer corners of the front and back walls 46 and 48, and the corresponding tabs 72 are located in the top outer comers of the inside front and back sections 66 and 68. Any other suitable locking means could also be provided. Of course, it is not necessary to providing a locking means if it is not desired that the inside front and back sections 66 and 68 remain in place.

Additionally, one or more thumb tabs 74 can be provided along the edges of the protector 30 to assist the user in opening the protector. In the embodiment depicted in FIG. 3, two thumb tabs 74 are provided, one on the front half 34 of the protector and one on the back half 36.

The tag protector 30 can be made of any suitable transparent material that allows the user to read the tag through the protector. Preferably the tag protector 30 is made of a clear plastic material, such as polyvinylchloride, polycarbonates, polyethylene (e.g., PET-G or A-PET), and polyesters.

If desired, the tag protector 30 can also be made of a generally pigmented material that is optically transparent. Additionally, a logo or other design can be embossed into the material.

The tag protectors 30 can be manufactured by any suitable method. A preferred method for making the inventive tag protectors 30 is by thermoforming techniques (not shown). Generally, the material used to make the protector is provided in a large roll of sheet material which is unwound and fed through a heating element to soften the material. The material then goes onto a mold die, and mechanical and/or vacuum pressure is exerted on the softened material, whereby the material assumes the shape of the mold. The molded product, still in sheet form, is then passed through a die-cutting process to cut out the individual protectors.

The preceding description has been presented with reference to presently preferred embodiments of the invention. Workers skilled in the art and technology to which this invention pertains will appreciate that alterations and changes in the described structure may be practiced without meaningfully departing from the principal, spirit and scope of this invention. Accordingly, the foregoing description should not be read as pertaining only to the precise structures described and illustrated in the accompanying drawings, but rather should be read consistent with and as support to the following claims which are to have their fullest and fair scope.

We claim:

1. A removable tag protector made of a generally transparent material and comprising:

an outside section comprising:

a front half having an inside face, an outside face, an inner edge, an outer edge, and a front wall extending along at least a part of the outer edge of the front half, a back half having an inside face, an outside face, an inner edge, an outer edge, and a front wall extending along at least a part of the outer edge of the back half, and a midsection having front and back side edges;

wherein the inner edge of the front half is joined to and foldable along the front edge of the midsection, and the inner edge of the back half is joined to and foldable along the back edge of the midsection, whereby the outside section is capable of being folded to form an inner region between the front half and back half;

an inside front section having an inside face and an outside face, the inside front section being hinged to the front half of the outside section and capable of being folded into a position within the inner region of the outside section so that the inside front section is generally parallel to the inside face of the front half;

an inside back section having an inside face and an outside face, the inside back section being hinged to the back half of the outside section and capable of being folded into a position within the inner region of the outside section so that the inside back section is generally parallel to the inside face of the back half; and a closing means capable of attaching the outer edge of the front half of the outside section to the outer edge of the back half of the outside section.

2. A tag protector according to claim 1, wherein the inside front section is attached to the top of the front half of the outside section and the inside back section is attached to the top of the back half of the outside section.

3. A tag protector according to claim 1, wherein the inside front section is attached to the bottom of the front half of the outside section and the inside back section is attached to the bottom of the back half of the outside section.

4. A tag protector according to claim 1, wherein the tag protector, when closed, is generally heart-shaped.

5. A tag protector according to claim 1, wherein the closing means comprises at least one snapping mechanism.

6. A tag protector according to claim 5, wherein the snapping mechanism comprises:

a ridge near the outer edge of the inside face of the front half of the outside section; and a corresponding valley near the outer edge of the inside face of the back half of the outside section, the valley being capable of snapably receiving the ridge on the front half.

7. A tag protector according to claim 5, wherein the snapping mechanism comprises:

a ridge near the outer edge of the inside face of the back half of the outside section; and a corresponding valley near the outer edge of the inside face of the front half of the outside section, the valley being capable of receiving the ridge on the front half.

8. A tag protector according to claim 1, further comprising a front locking means for maintaining the inside front section in place in the interior region of the protector.

9. A tag protector according to claim 8, wherein the front locking means comprises a slit in the front wall on the front half of the outside section and a corresponding tab on the edge of the inside front section, whereby the slit is capable of receiving the corresponding tab.

10. A tag protector according to claim 9, wherein the slit is in the bottom section of the front wall and the tab is on the bottom edge of the inside front section.

11. A tag protector according to claim 9, wherein the slit is in the top section of the front wall and the tab is on the top edge of the inside front section.

12. A tag protector according to claim 9, further comprising a back locking means for maintaining the inside back section in place in the interior region of the protector, wherein the back locking means comprises a slit in the back wall on the back half of the outside section and a corresponding tab on the edge of the inside back section, whereby the slit is capable of receiving the corresponding tab.

13. A tag protector according to claim 8, further comprising a back locking means for maintaining the inside back section in place in the interior region of the protector.

14. A tag protector according to claim 1, further comprising a back locking means for maintaining the inside back section in place in the interior region of the protector.

15. A tag protector according to claim 14, wherein the back locking means comprises a slit in the back wall on the back half of the outside section and a corresponding tab on the edge of the inside back section, whereby the slit is capable of receiving the corresponding tab.

16. A tag protector according to claim 15, wherein the slit is in the bottom section of the back wall and the tab is on the bottom edge of the inside back section.

17. A tag protector according to claim 15, wherein the slit is in the top section of the back wall and the tab is on the top edge of the inside back section.

18. A removable tag protector for releasably enclosing a generally planar tag having a predetermined shape with a fold line that separates the tag into front and back sides, the tag protector being made of a generally transparent material and comprising:

a base having an inside face with a front half and a back half so that the tag, when in its unfolded position, can overlie the front and back halves of the base, respectively;

a fold section dividing the front and back halves of the base so that the front and back halves of the base can be folded into an overlapping position when the base is folded along the fold section;

a front wall section along an outside edge of the front half of the base;

a rear wall section along an outside edge of the back half of the base;

an inside front protective section hinged to the front wall or the base for overlying the front side of the unfolded tag when the tag is positioned to overlie the base so that the inside front protective section is folded to overlie the front side of the unfolded tag;

an inside rear protective section hinged to the back wall or the base for overlying the back side of the unfolded tag when the tag is positioned to overlie the base so that the inside rear protective section is folded to overlie the front section of the unfolded tag; and cooperating closing means on the front and rear wall sections arranged so that the closing means are formed together in a releasably fastened position when the front and back halves of the base are folded along said fold section and moved to said overlapping position, whereby when a tag is positioned on the base and moved to a folded position in response to the front and back halves being folded to the fastened position, the folded tag is captured inside the folded base with the front and rear protective sections overlying their respsective sides of the tag and contained within the fastened and folded base.

19. A tag protector according to claim 18, wherein the inside front protective section is attached to the front wall.

20. A tag protector according to claim 18, wherein the inside front protective section is attached to the base.

21. A tag protector according to claim 18, wherein the inside rear protective section is attached to the back wall.

22. A tag protector according to claim 18, wherein the inside rear protective section is attached to the base.

23. A tag protector according to claim 18, wherein the inside front protective section is attached to the top of the front wall or to the top of the base and the inside rear protective section is attached to the top of the back wall or to the top of the base.

24. A tag protector according to claim 18, wherein the inside front protective section is attached to the bottom of the front wall or to the bottom of the base and the inside rear protective section is attached to the bottom of the back wall or to the bottom of the base.

25. A tag protector according to claim 18, wherein the closing means comprises at least one snapping mechanism.

* * * * *